United States Patent [19]

Nishikawa

[11] Patent Number: 4,629,279

[45] Date of Patent: Dec. 16, 1986

[54] CONNECTOR HOUSING

[75] Inventor: Yasuo Nishikawa, Yokkaichi, Japan

[73] Assignee: Tokai Electric Wire Company Limited, Mie, Japan

[21] Appl. No.: 612,358

[22] Filed: May 21, 1984

[30] Foreign Application Priority Data

May 25, 1983 [JP] Japan ..... 58-79116[U]

[51] Int. Cl.[4] ..... H01R 13/514

[52] U.S. Cl. ..... 339/210 M; 339/59 M; 339/176 M; 339/97 P

[58] Field of Search ..... 339/59 R, 59 M, 63 R, 339/63 M, 176 M, 210 R, 210 M, 97 R, 97 P, 98, 99 R, 121, 198 H, 198 G, 49 R

[56] References Cited

U.S. PATENT DOCUMENTS

| | | | |
|---|---|---|---|
| 3,233,209 | 2/1966 | Lazar et al. | 339/210 R |
| 3,239,796 | 3/1966 | Buchanan et al. | 339/176 M |
| 3,519,978 | 7/1970 | Taormina et al. | 339/59 M |
| 3,605,068 | 9/1971 | Rayburn | 339/198 H |
| 3,641,482 | 2/1972 | Bretting | 339/210 M |
| 3,945,705 | 3/1976 | Seim et al. | 339/210 M |
| 3,971,616 | 7/1976 | Hashimoto | 339/98 |
| 4,040,703 | 8/1977 | Shaffer et al. | 339/210 R |
| 4,159,158 | 6/1979 | Weidler | 339/97 P |
| 4,286,836 | 9/1981 | Rumps | 339/97 R |
| 4,445,737 | 5/1984 | Long et al. | 339/97 P |

*Primary Examiner*—Gil Weidenfeld
*Assistant Examiner*—Thomas M. Kline
*Attorney, Agent, or Firm*—Ernest A. Beutler

[57] ABSTRACT

A connector housing formed with a multiplicity of compartments arranged in a transversely extending single row for receiving terminals therein. The connector housing has a left-half portion and a right-half portion pivotably connected together through a hinge of a small thickness at opposite edge portions. One of the left-half portion and right-half portion can be pivotally moved at the hinge to bring the two half portions into superposed relation to arrange the compartments in two layers.

4 Claims, 7 Drawing Figures

CONNECTOR HOUSING

FIELD OF THE INVENTION

This invention relates to an improvement in a connector housing partitioned into a multiplicity of compartments each for receiving a terminal fitted therein.

DESCRIPTION OF THE PRIOR ART

Figure 1:
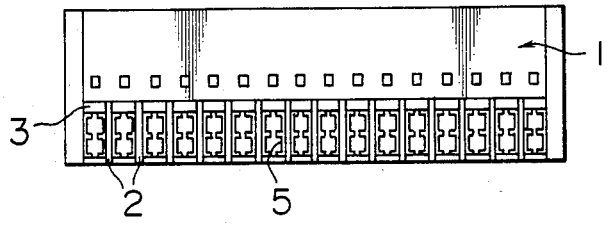
FIG. 1 PRIOR ART
FIG. 1 is a plan view of one example of the connector housing of the prior art.
Figure 2:
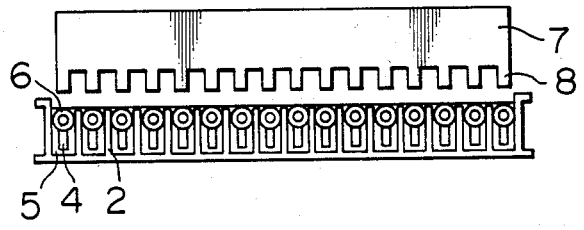
FIG. 2 PRIOR ART
FIG. 2 is a front view of the connector housing shown in FIG. 1.
Figure 3:
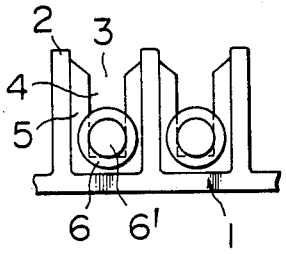
FIG. 3 PRIOR ART
FIG. 3 is a fragmentary view, on an enlarged scale, of the connector housing shown in FIG. 2.

Heretofore, in one type of connector housing, it has been inevitable to arrange its compartments for containing terminals in a transversely extending row of a single layer due to limitations placed on the connector housing by the type of connectors or a working process. More specifically, in this type of connector housing, the housing 1 is open at its top side and divided by partition walls 2, as shown in FIGS. 1–3, into a multiplicity of compartments 3 arranged in a transversely extending row, and a pressure contact terminal 5 having a slot 4 in the form of a letter U (hereinafter U-slot) is fitted in each of the compartments 3. Then, as shown in FIG. 2, a sheathed wire 6 is placed on each of the pressure contact terminals 5 or on an upper end of the U-slot 4 of each pressure contact terminal 5, and the sheathed wires 6 are force fitted into the respective U-slots 4 by using a pressure contacting jig 7 formed with pressure contact pieces 8 for applying pressures to the respective sheathed wires 6. When the sheathed wires 6 are force fitted in the respective U-slots 4, their sheathings are cut by opposite edges of each of the U-slots 4, as shown in FIG. 3. Thus, a core 6′ of each of the wires 6 is connected to the respective pressure contact terminal 5.

In the connector housing of the aforesaid constructional form, it is essential that the pressure contacting jig 7 be used for force fitting the sheathed wires 6 into the U-slots 4 for connecting them together. Thus, it is inevitable that the compartments 3 for containing the pressure contact terminals 5 and wires 6 be arranged in a transversely extending single row.

In one working process of connecting wires with terminals by utilizing a connector housing, a series of steps of cutting wires, stripping sheathings off wire end portions, force fitting stripped wire end portions to terminals and fitting the terminals in the connector housing may be performed automatically. When such process is performed, efficiency can be maximized by arranging in a transversely extending single row an array of wires having terminals force fitted thereto and inserting such array of wires with terminals in a multiplicity of compartments arranged in a transversely extending single row of a single layer. Thus, the compartments for containing the wires force fitted to the terminals have to be arranged in a transversely extending single row.

Accordingly, when a wire harness using the connector housing 1 shown and described hereinabove is mounted in a vehicle body, it is necessary that a window for fitting such wire harness be formed in the vehicle body in such a manner that it has a width matching the width of the connector housing including a transversely extending single row of compartments. This has given rise to the problems that the strength of the vehicle body might be reduced and difficulties might be experienced in fitting the connector housing 1 of a large width in the window, thereby deteriorating operability.

SUMMARY OF THE INVENTION

This invention has been developed for the purpose of obviating the aforesaid problems of the prior art. Accordingly, the invention has as its object the provision of a connector housing which is compact in size and causes no reduction ih the strength of a vehicle body.

The outstanding characteristic of the invention enabling the aforesaid object to be accomplished is that the connector housing divided into a multiplicity of compartments for fitting terminals arranged in a transversely extending single row of a single layer comprises a left-half portion and a right-half portion pivotably connected together through a hinge of a small thickness at opposed edge portions, whereby the left-half portion and the right half-portion of the connector housing can be superposed one over the other by pivotally moving them to arrange the housing in two layers.

DESCRIPTION OF THE PREFERRED EMBODIMENT

A preferred embodiment of the invention will now be described by referring to the accompanying drawings.

Figure 4:
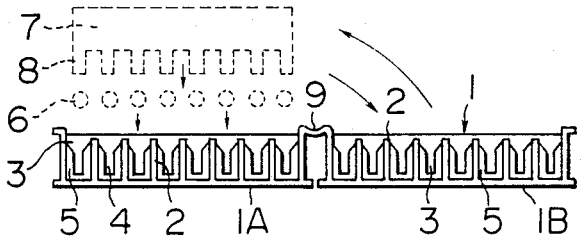
FIG. 4 is a front view of the connector housing comprising one embodiment of the invention.
Figure 5:
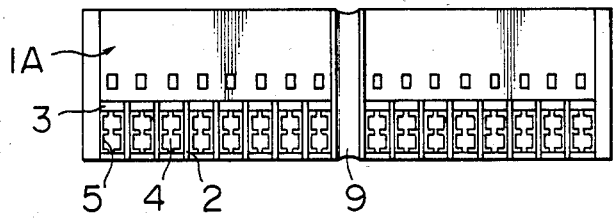
FIG. 5 is a plan view of the connector housing shown in FIG. 4.
Figure 6:
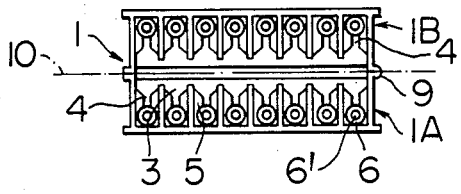
FIG. 6 is a front view of the connector housing shown in FIG. 5, showing the form it assumes when it is placed in service.

Referring to FIGS. 4–7, a connector housing 1 according to an embodiment of the invention includes a left-half portion 1A and a right-half portion 1B which are symmetrical in shape. A hinge 9 of a small thickness is provided to pivotably connect the left-half portion 1A and right-half portion 1B together at opposing edge portions, so that one of them can be pivotally moved through 180 degrees and placed on the other as shown in FIG. 6 in which the left-half portion 1A and right-half portion 1B are arranged in two layers in such a manner that they are symmetrical with respect to an interface 10. The connector housing 1 including the left-half portion 1A and right-half portion 1B of the aforesaid construction is divided by partition walls 2 into a multiplicity of compartments 3 which are open at the top and arranged in a transversely extending single row. Pressure contact terminals 5 each formed with a U-slot 4 are fitted in one of the compartments 3.

Figure 7:
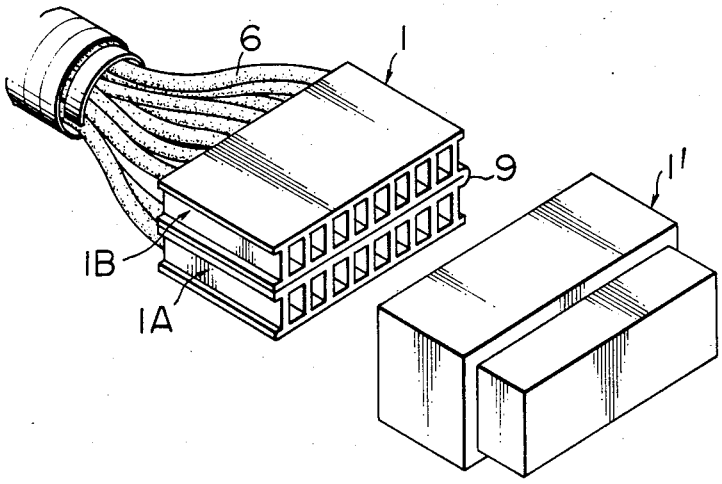
FIG. 7 is a perspective view of the connector housing shown in FIG. 5, showing the manner in which it is placed in service.

The connector housing 1 of the aforesaid constructional form according to the invention is shown in FIG. 4 in a free state in which the left-half portion 1A and right-half portion 1B are connected in series with each other. End portions of sheathed wires 6 are supplied to a position above the connector housing 1 of the aforesaid condition and pressed by a pressure contacting jig 7 formed at its lower end with a multiplicity of pressure contact pieces 8 as shown in phantom lines in FIG. 4, to force fit the sheathed wires 6 through the opening at the top of the compartments 6 into the U-slots 4 of the respective pressure contact terminals 5 in the compartments 3. The sheathing of each wire 6 is cut by opposite edge portions of the U-slot 4 when force fitted, to bring a core 6' of each sheathed wire 6 into contact with the respective pressure contact terminal 5 to be connected thereto through pressure contact. Then, the right-half portion 1B is pivotally moved through 180 degrees and placed on the left-half portion 1A in superposed relation. Thus, as shown in FIG. 6, the left-half portion 1A and right-half portion 1B are connected together with the open ends of the compartments 3 being disposed in juxtaposed relation, to provide a connector housing of two layers. The connector housing 1 of two layer construction is placed in service by being connected with a female type connector housing 1' or opposite member as shown in FIG. 7.

In the connector housing 1 of the aforesaid constructional form, the compartments 3 are disposed in a transversely extending single row of one layer with their top end open when the wires 6 are brought into pressure contact with the terminals 5, and then formed into two layers after pressure contacting of the terminals 5 by the wires 6 is finished. Thus, when it is placed in service, the connector housing 1 according to the invention has a width which is substantially one-half that of the connector housing of the prior art construction shown in FIGS. 1–3, enabling an overall compact size to be obtained in a connector housing.

When a wire harness incorporating therein the connector housing 1 of the aforesaid constructional form according to the invention is mounted to a vehicle body, it is possible to reduce the size of a window formed in the vehicle body for receiving the wire harness as compared with that of a window for receiving a wire harness incorporating therein a connector housing of the prior art. This reduces the influence exerted by the connector housing of the prior art on the strength of the vehicle body and facilitates the operation of mounting the wire harness in the window, thereby improving operability. An additional advantage offered by the invention is that the connector housing can be readily handled before being mounted to a vehicle body, particularly when it is transported, because the connector housing according to the invention is small in width and compact in size.

The embodiment of the invention shown and described hereinabove is not restrictive and merely for illustrative purposes. Although not shown, it is possible, of course, to fit ordinary terminals in the compartments. In one modification, the compartments need not have an open top, and an array of terminals pressure contacting end portions of wires may be automatically inserted in the compartments 3 as they are located in a transversely extending single row by opening the hinge 9, before closing the hinge 9 to form the compartments 6 and hence the left-half portion 1A and right-half portion 1B into two layers. Thus, it is possible for this modification to achieve the same effects as achieved by the embodiment shown and described hereinabove without reducing the operability of the processes of automatically bringing the wires into contact with the terminals.

In the connector housing of the constructional form shown in FIGS. 4–7, the left-half portion 1A and right-half portion 1B disposed in superposed relation may be secured to each other at the interface by any known suitable means, including adhesive bonding, melt adhesion and locking by means of claws attached to the left-half portion 1A and right-half portion 1B. In the embodiment shown in FIGS. 4–7, the hinge 9 is located in a position near the top end of the compartments 3 and the compartments 3 of two layers are juxtaposed against each other through the open end thereof when the connector housing is put to use. The invention is not limited to this arrangement of the hinge 9, and the hinge 9 may be located in a position near the lower end of the compartments 3, so that the open top end of the compartments 6 of the left-half portion 1A and right-half portion 1B may face outwardly when the left-half portion 1A and right-half portion 1B are brought to a superposed relation as shown in FIG. 6. However, the embodiment shown in FIGS. 4–5 is preferable because it eliminate the need to additionally provide the pressure contact terminals 5 with protective plates.

From the foregoing description, it will be appreciated that the connector housing according to the invention incorporates therein an improvement for connecting the wires with the terminals, and that the improved connector housing is compact in size and conductive to improved operability of the process of automatically bringing the wires into pressure contact with the terminals.

What is claimed is:

1. A connector housing divided by partition walls into a multiplicity of compartments arranged in a transversely extending single row, each of said compartments being sized for fitting a respective terminal therein, said terminals each defining a "U" shaped slot therein, said connector housing comprises a left-half portion and a right-half portion pivotably connected together through a hinge of a small thickness at adjacent edges of said portions, said portions defining open top ends at the tops of said compartments when said portions are in an opened pivotal position, said portions being pivotal about an axis defined by said hinge which axis extends parallel to said compartments from said opened pivotal position to bring the two half portions into superimposed relation to arrange the compartments into two layers in a closed pivotal position wherein said open top ends of said compartments face each other when the portions are disposed in said superimposed relation.

2. A connector housing as set forth in claim 1 wherein each of the compartments is configured to receive and pass a conductor extending through one side of the connector housing and to which a terminal is affixed that is fitted within the respective connector housing compartment, the other side of said connector housing being configured to afford mechanical attachment to a cooperating connector housing with the terminals of the connector housing being electrically connected with corresponding terminals of the cooperating connector housing.

3. A connector housing as set forth in claim 2 wherein the terminals comprise conductive members defining the U-shape slot each received in a respective one of the compartments, said slots being configured so as to strip insulation from the conductors to afford an electrical connection between the conductor thereof and the respective terminal.

4. A connector housing as set forth in claim 3 wherein the compartments are sized to receive a corresponding jig for urging the conductors into engagement with the terminals for stripping the insulation therefrom.

* * * * *